US010948260B1

(12) United States Patent
Jones

(10) Patent No.: US 10,948,260 B1
(45) Date of Patent: Mar. 16, 2021

(54) ARCHERY RELEASE

(71) Applicant: H.I.T. Outdoors, LLC, Clay City, KY (US)

(72) Inventor: Brian K. Jones, Georgetown, KY (US)

(73) Assignee: H.I.T. Outdoors, LLC, Clay City, MI (US)

( * ) Notice: Subject to any disclaimer, the term of this patent is extended or adjusted under 35 U.S.C. 154(b) by 0 days.

(21) Appl. No.: 16/826,914

(22) Filed: Mar. 23, 2020

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS

| | | | | |
|---|---|---|---|---|
| X228302 | | 6/1880 | Beard | |
| X229089 | | 6/1880 | Burnham | |
| 3,853,111 | A | 12/1974 | Stanislawski et al. | |
| 3,965,884 | A | 6/1976 | Killian | |
| 4,004,564 | A * | 1/1977 | Castonguay | F41B 5/1469 124/35.2 |
| 4,036,204 | A | 7/1977 | Scott | |
| 4,041,926 | A | 8/1977 | Troncoso et al. | |
| 4,160,437 | A | 7/1979 | Fletcher | |
| 4,316,443 | A * | 2/1982 | Giacomo | F41B 5/1469 124/35.2 |
| 4,509,497 | A | 4/1985 | Garvison | |
| 4,539,968 | A | 9/1985 | Garvison | |
| 4,567,875 | A | 2/1986 | Fletcher | |
| 4,574,767 | A | 3/1986 | Gazzara | |
| 4,620,523 | A | 11/1986 | Peck | |
| 4,674,469 | A | 6/1987 | Peck | |
| 4,854,293 | A | 8/1989 | Roberts | |
| 4,881,516 | A | 11/1989 | Peck | |

(Continued)

FOREIGN PATENT DOCUMENTS

WO 2018075590 A1 4/2018

OTHER PUBLICATIONS

Various prior art releases (1) downloaded from http://www.archeryhistory.com/releases/releasespics/release4.jpg on Dec. 29, 2009.

(Continued)

*Primary Examiner* — John A Ricci
(74) *Attorney, Agent, or Firm* — Warner Norcross + Judd, LLP

(57) ABSTRACT

An archery release is provided including a multi-bar linkage that extends from a trigger button, through a handle, an arm, and a release head, to a sear having a bowstring notch, where the linkage can be used to both set the release to a set mode and a release mode. In the set mode, the sear is nonrotatable about a sear axis and configured so a bowstring is retained in the bowstring notch. In the release mode, the sear is rotatable about the sear axis, so the bowstring can be released from the bowstring notch. The housing can define a compartment, and the bar linkage can snake through the compartment. A bias element can urge the linkage to press a tip of the sear against the housing in the set mode. When the linkage is moved, it disengages the sear, converting it to the release mode.

20 Claims, 5 Drawing Sheets

(56) References Cited

U.S. PATENT DOCUMENTS

| | | | | |
|---|---|---|---|---|
| 5,009,214 | A | 4/1991 | Wilde | |
| 5,025,772 | A | 6/1991 | Stevenson | |
| 5,103,796 | A * | 4/1992 | Peck | F41B 5/1469 124/35.2 |
| 5,205,268 | A | 4/1993 | Savage | |
| 5,261,581 | A | 11/1993 | Harden | |
| 5,273,021 | A | 12/1993 | Tepper | |
| 5,323,754 | A | 6/1994 | Pittman et al. | |
| 5,448,983 | A | 9/1995 | Scott | |
| 5,546,924 | A | 8/1996 | Todd | |
| 5,595,167 | A | 1/1997 | Scott | |
| 5,596,977 | A | 1/1997 | Scott | |
| 5,685,286 | A | 11/1997 | Summers | |
| 5,694,915 | A | 12/1997 | Summers | |
| 5,765,536 | A | 6/1998 | Scott | |
| 5,803,068 | A | 9/1998 | Summers | |
| 5,850,825 | A | 12/1998 | Scott | |
| 5,937,842 | A | 8/1999 | Summers et al. | |
| 6,032,661 | A | 3/2000 | Goff et al. | |
| 6,571,786 | B2 | 6/2003 | Summers et al. | |
| 6,631,709 | B2 | 10/2003 | Carter et al. | |
| 6,736,124 | B2 | 5/2004 | Carter | |
| 6,895,951 | B2 | 5/2005 | Summers et al. | |
| 6,945,241 | B2 | 9/2005 | Pellerite | |
| 6,953,035 | B1 | 10/2005 | Summers et al. | |
| 7,654,254 | B1 | 2/2010 | Rentz et al. | |
| 7,926,475 | B2 * | 4/2011 | Jones | F41B 5/1469 124/35.2 |
| 8,622,051 | B2 | 1/2014 | Summers et al. | |
| 9,097,485 | B2 * | 8/2015 | Lipowski | F41A 19/10 |
| 10,012,467 | B2 * | 7/2018 | Meadows | F41B 5/1469 |
| 10,240,887 | B1 * | 3/2019 | Henry | F41B 5/1469 |
| 2004/0079351 | A1 | 4/2004 | Summers et al. | |
| 2008/0149084 | A1 | 6/2008 | Whalen et al. | |
| 2009/0090342 | A1 | 4/2009 | Freitag et al. | |
| 2009/0095270 | A1 | 4/2009 | Graves | |
| 2010/0108047 | A1 | 5/2010 | Jones | |
| 2011/0168146 | A1 | 7/2011 | Deceuster | |
| 2012/0192844 | A1 | 8/2012 | Springer | |
| 2012/0285431 | A1 | 11/2012 | Summers et al. | |
| 2013/0025578 | A1 | 1/2013 | Jones | |

OTHER PUBLICATIONS

Various prior art releases (2) downloaded from http://www.archeryhistory.com/releases/releasespics/release4.jpg on Dec. 29, 2009.

Prior art releases (3) downloaded from http://www.archeryhistory.com/releases on Jul. 21, 2011.

Prior art releases (4) downloaded from http://www.archeryhistory.com/releases on Jul. 21, 2011.

Longhorn Hunter (Jan. 2010).

* cited by examiner

ARCHERY RELEASE

BACKGROUND OF THE INVENTION

The present invention relates to an archery release aid, and more particularly to a hand held archery release with a handle.

Conventional archery releases are designed to temporarily hold a bowstring of an archery bow so that an archer can pull on the release and subsequently draw the bowstring to shoot an arrow from the bow. Archery releases typically assist an archer in quickly and cleanly releasing the bowstring. In general, archery releases are intended to consistently release the bowstring when the archer shoots the arrow, and thus increase the accuracy of the shot.

A common type of release used by some archers, and in particular many competitive archers, is a hand held release, which is generally held in an archer's hand during a shot sequence. One hand held release is a thumb release, which includes a trigger assembly that is mechanically actuated by a thumb trigger configured to be engaged by a user's thumb. This thumb release can be held in a user's hand with one or more fingers on the handle, while the thumb is positioned over the thumb trigger. To activate the thumb release, the archer engages the thumb trigger, which in turn engages the trigger assembly, causing the string hook to pivot and release the bowstring.

Thumb releases also have a complicated system of pawls and sears associated with the trigger assembly, as well as a separate hook set assembly which is used to set the trigger and thus the string hook in a fixed position so that it will not release the bowstring before the trigger assembly is actuated. The hook set assembly of conventional thumb releases includes a set button that is separate from and protrudes from the thumb release distal from the trigger. To set the hook with this hook set assembly, a user must manually depress the set button when the bowstring is captured in the hook. This in turn rotates and actuates a set of pawls to lock the hook in the fixed position. To release the hook, as noted above, the user engages the separate trigger assembly having yet another set of sears and pawls.

While thumb releases with a trigger assembly and a separate set assembly are functional, they require that two separate sets of components be installed in the release. These parts are numerous, so they are time consuming to install and are difficult to time perfectly so they function well. The parts also in many cases must be manufactured with low tolerances and very hard steel, or polished or treated so they move smoothly and crisply relative to one another. Thus, many of the parts of the two assemblies are rather expensive to manufacture as well. Further, as noted above, with the extra set assembly, the user must perform an extra operation of pushing the set button to ready the hook to hold the bowstring.

Accordingly, there remains room for improvement with regard to the setting of a release hook and the associated components of a thumb release.

SUMMARY OF THE INVENTION

An archery release is provided in the form of a hand held release including a multi-bar linkage that extends from a trigger button, through a handle, an arm, and a release head, to a sear having a bowstring notch. The linkage can be used both to set the sear in a set mode in which the sear is non-rotatable about a sear axis and so a bowstring is retained in the bowstring notch, as well as a release mode in which the sear is rotatable about the sear axis, so the bowstring can be released from the bowstring notch.

In one embodiment, the release can comprise a housing that defines a compartment through which the multi-bar linkage can snake. The housing can be outfitted with only two openings when assembled and ready to use. The housing can define a sear opening through which part of a bowstring hook projects, and a trigger bar opening through which a trigger bar or part of a trigger button projects.

In another embodiment, the housing can form a handle, configured to engage an archer's digits, and an arm extending toward and joined with a release head, which can include the sear defining the bowstring notch. The arm can be configured to be placed between the archer's digits, and can connect the head and the remainder of the handle. The compartment can be formed through at least one of the handle, the arm and the release head.

In still another embodiment, the sear bar can extend through the arm. The sear bar can be rotatable about a sear bar pin joined with the arm, optionally projecting in to the compartment. The sear bar pin can be located a distance from a sear axis about which the sear can rotate when the release transitions from a set mode to a release mode and vice versa.

In yet another embodiment, the bar linkage can include a connector bar that extends through the handle. The connector bar can be free floating within the compartment. The connector bar can include a first end joined with the sear bar via a first connector bar pin. The connector bar can include a second end joined with the trigger bar via a second connector bar pin.

In even another embodiment, the connector bar can be transverse to the sear bar, and to the trigger bar. In some cases, the connector bar can be offset at a first angle between 75° and 105°, inclusive, relative to the sear bar. In some cases, the connector bar can be offset at a second angle between 75° and 105°, inclusive, relative to the trigger bar.

In a further embodiment, the release can include a bias element. The bias element can be a spring that is disposed in the compartment, optionally adjacent the connector bar. The spring can urge the sear bar to rotate about the sear bar axis and can urge the trigger bar to rotate about the trigger bar axis so that the sear bar is urged to the set mode.

In still a further embodiment, the sear and sear bar can be constructed from stainless steel, with the sear edge and bar edge honed to well-defined edges with extreme precision. Thus, these two components optionally can be the only stainless parts in the assembly. The other bars and parts of the linkage can be lower grade steel or metal, and can be formed to less exacting tolerances.

An efficient archery release is provided that includes minimal parts in a multi-bar linkage that serves as both a setting assembly and a trigger assembly. With the multi-bar linkage, the combined setting and trigger assembly can be constructed with minimal parts. The linkage can be mounted and rotatable relative to the housing at optionally three pivot axes to exert minimal friction on the linkage as it is actuated and set. Where the sear bar and sear are the only parts made with extreme precision and exacting tolerances, the other parts can be of lower tolerances and precision, yet the release can still function well. This can enable the release to be constructed at a lower cost. Additionally, because of the few parts in the linkage, the release takes minimal time to assemble, and the fewer parts means less energy and materials are consumed in the manufacture of the release.

These and other objects, advantages, and features of the invention will be more fully understood and appreciated by reference to the description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
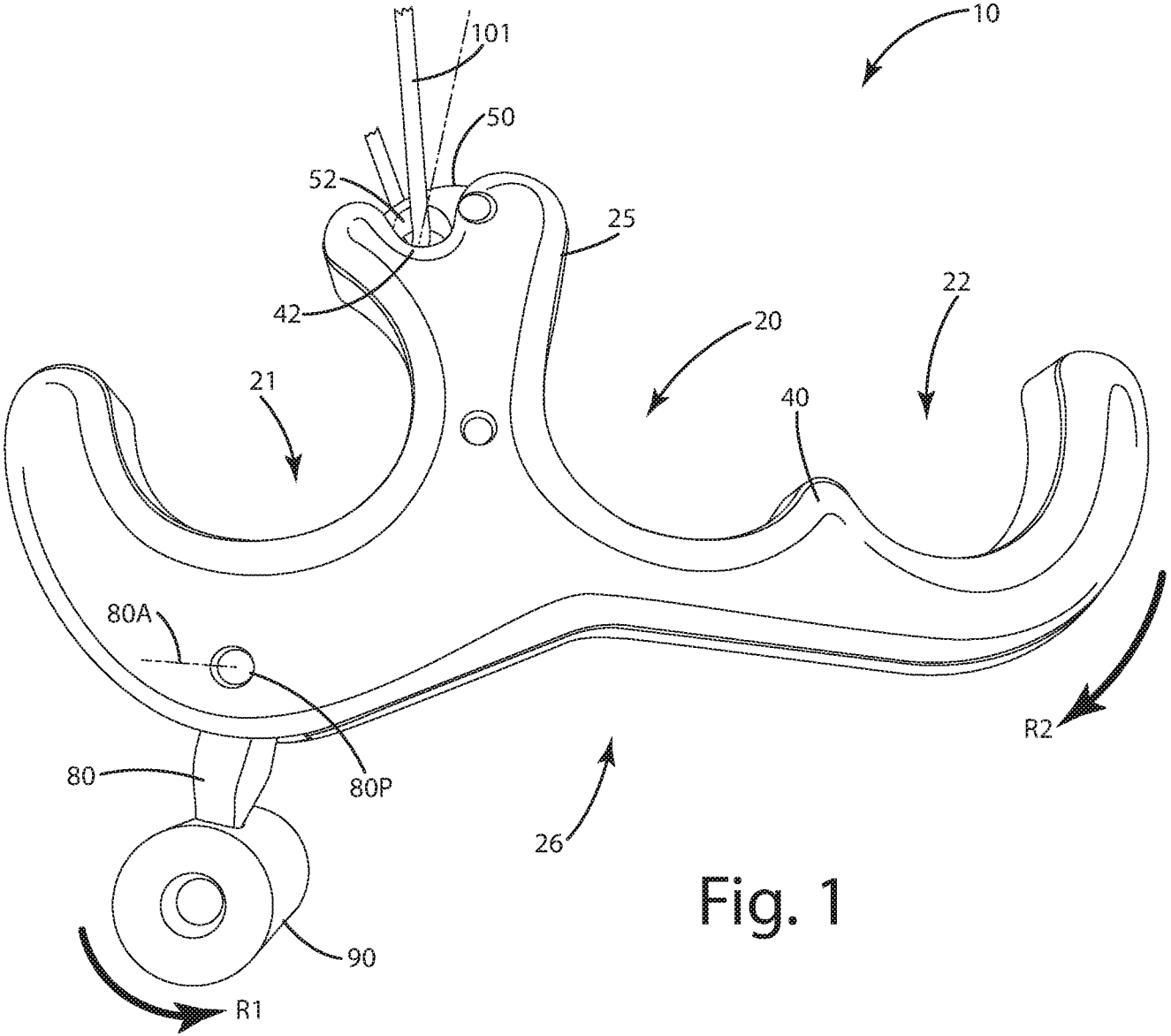
FIG. 1 is an upper perspective view of the archery release of a current embodiment in a set mode, with a bowstring engaged by the release.
Figure 2:
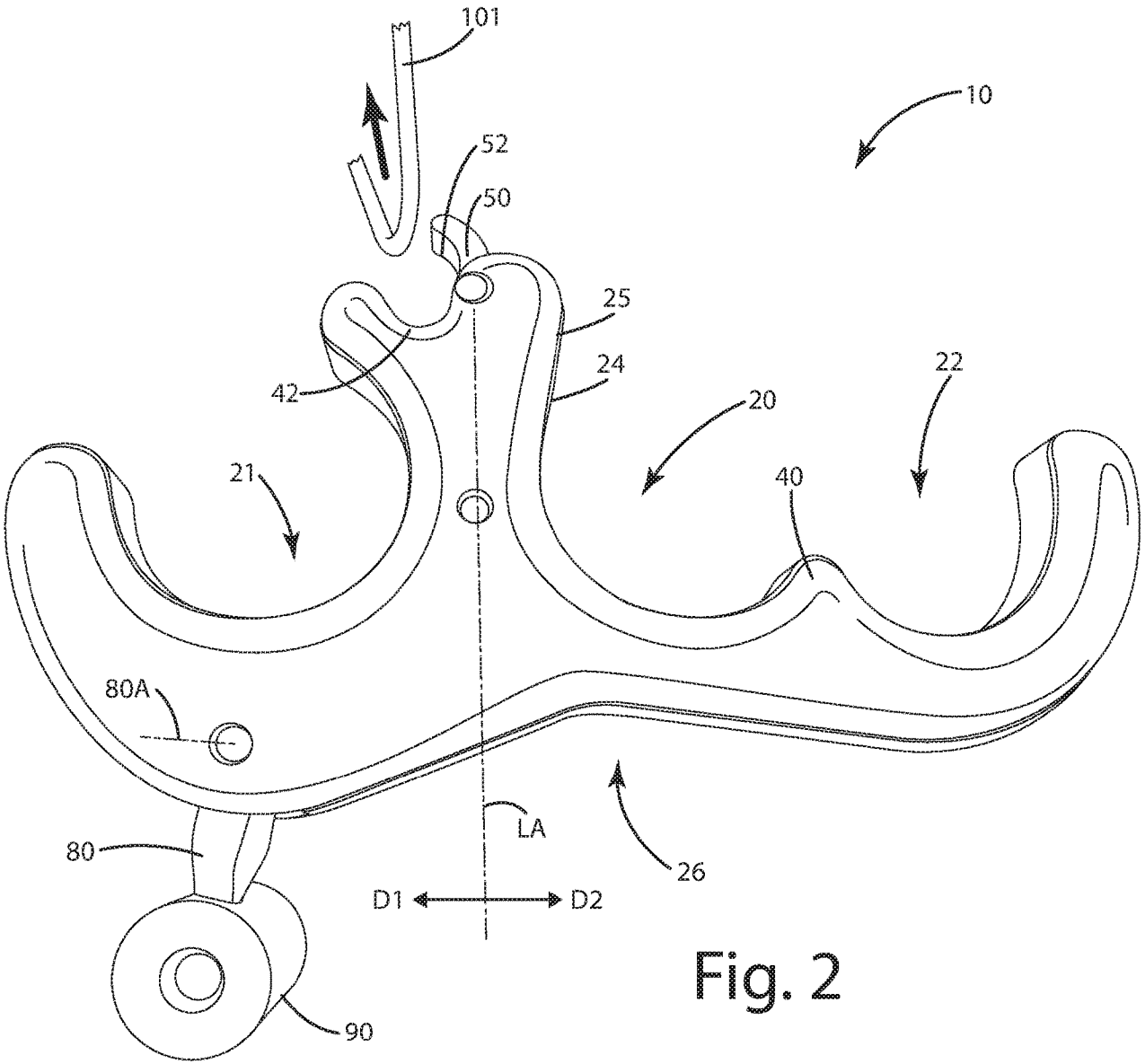
FIG. 2 is an upper perspective view of the archery release in a release mode with the bowstring being released.

A current embodiment of the archery release is shown in FIGS. 1-4 and generally designated 10. The release 10 is in the form of a hand held release, in particular a thumb release; however, the current embodiment can be utilized with a variety of different types of releases, for example, back tension releases, plunger releases, pinky releases, rope releases, and other types of handheld releases modified as described herein to be tethered to a wrist strap. The release 10 can include a release body 20 joined with a release head 25. The release can include a housing 40 defining a compartment 43. A cover 44 can close the compartment 43 and can be attached to the housing 40. A multi-bar linkage 30 can be movably disposed in the compartment. The linkage can operably connect the sear 50 with the trigger button 90 to attain set and release modes of the release 10. The linkage 30 can include a sear bar 60 pivotally joined with a connector bar 70, pivotally joined with a trigger bar 80 which is joined with the trigger button 90. The linkage also can operate in both a set mode to fix the sear in a fixed immovable position, and a release mode in which the sear is released to release the bowstring. Of course, more or fewer bars can be included in the linkage as described below.

The release 10 can include an arm 24, which can extend between an archer's digits and can form a portion of a release body 20, which can further include a handle 26. The handle can include a primary portion 21 that engages a user's pointer finger and a secondary portion 22 that engages a user's middle, ring and pinky fingers, or any number of the same. Of course, the portions can be reoriented to accommodate or engage other combinations of fingers or digits.

The release can be used to assist the archer in drawing and releasing the bowstring 101. When the release 10, as shown in FIG. 1, is used to draw the bowstring 100, the bowstring 101 is captured by the sear 50 in a bowstring notch 52. As the archer draws the bowstring, the sear 50 remains engaged with the bowstring 100. After the bowstring is drawn with the release 10, the archer, holding the handle 26 can engage the trigger button 90 and rotate it in direction R1 about the axis 80A, which can be aligned with the trigger bar pin 80P. When such movement occurs, the sear 50 disengages the multi-bar linkage 30 as described below. Upon such a disengagement, the sear 50 is free to rotate, and thus release the bowstring 100 from the bowstring notch 52 of the sear, thereby shooting the bow with which the release is used.

As used herein, bowstring refers to an actual bowstring of an archery bow and any device or component adapted to join with a bowstring of an archery bow and aid an archer in drawing or releasing the bowstring, including rope loops, which are attached to the bowstring above and below the location where an arrow nock rests, and receivers, for example, a metal loop or partial loop that is joined with the bowstring above and below, or only above, or only below the location where the arrow nock rests on the bowstring. Further, as used herein, archery bow refers to any compound bow, recurve bow, long bow, crossbow or any other device that propels or is capable of propelling an arrow, bolt or other similar projectile.

Referring to FIGS. 1-4 the components of the release 10 will now be described in more detail. The release 10 can include a release body 20, which can include a handle 26. The handle can define multiple grooves or recesses designed to accommodate one or more digits of a user as mentioned above. Optionally, the handle can be a straight bar or other suitable gripping structure to enable a user to grasp the release body 20. As shown in FIG. 1, an arm 24 can extend toward the release head 25 from the handle 26. The arm 24 can be an integral or separate from the handle 26 and remainder of the body 20 or housing 40. The handle 26 can include a primary handle portion 21 and the secondary handle portion 22, extending on opposite sides of the arm 24, in opposite directions D1 and D2 relative to the longitudinal axis LA of the arm. With the arm so positioned relative to the primary and secondary handle portions, the arm is configured to extend and fit between a user's digits when the handle is held in the user's hand, for example, between an archer's pointer finger and a ring finger. Optionally, the primary handle portion 21 can extend to support a pointer finger of an archer, wrapping partially or fully around and archer's pointer finger when in use. From or near this primary handle portion 21, the thumb or trigger button 90 and its associated trigger bar 80 can extend. This trigger button can be in the form of an elongated peg or cylinder having a surface texture or knurled surface to engage a user's thumb. The trigger button can be held and/or actuated by an archer's thumb during a draw cycle.

As shown in FIGS. 1-4, the release 10 can include a housing 40 defining a compartment 43. The compartment 43 can extend from a sear opening 250, through the head 25, through the arm 24, through the handle 26, through the primary portion 21 and to the trigger bar opening 800. The compartment 43 can be contiguous and of the same depth through all of these different components. The release 10 can include a cover 44. The cover 44 can be placed over the compartment 43 to close it off. The cover can extend throughout the length and width of the release 10. In particular, the cover can include a head portion 25C covers the compartment 43 in the head 25, and arm portion 24C that covers the compartment 43 in the arm 24, a primary cover portion 21C that covers the compartment 43 in the primary portion 21, and a secondary portion 22C that extends over and covers the secondary portion 22 of the handle 26. Of course, in other constructions, the cover 44 can cover the compartment 43 to close it off. In those cases, the cover 44 might not extend over other portions of the handle or release that do not define the compartment or portions thereof.

Optionally, the cover 44 can include alignment pins or bosses 44A, 45A and 46A. These alignment pins or bosses can secure to and can extend from the cover 44. These alignment bosses can fit within corresponding recesses 44B, 45B and 46B defined in the housing 40, and disposed distal from the compartment 43. Via the interfitment of the pins within corresponding recesses, the cover 44 can be precisely aligned over the housing 40 and the compartment. The perimeter of the respective housing and compartment also can be aligned perfectly to give a seamless well finished aesthetic to the release 10.

In some applications, the cover 44 can define one or more pin recesses 44P. These pin recesses 44P can be configured to receive respective sear pin 50P, sear bar pin 60P and/or trigger bar pin 80P. As described below, these pins can operate as axles or axes of rotation for the respective sear 50, sear bar 60 and trigger bar 80. The interlocking of the respective pins and their corresponding holes further enables the cover to be secured to the housing. In addition, with the recesses or holes 44P, the respective pins 50P, 60P and 80P can be stabilized and secured in place relative to both the housing and the cover to provide smooth rotation and movement.

Figure 3:
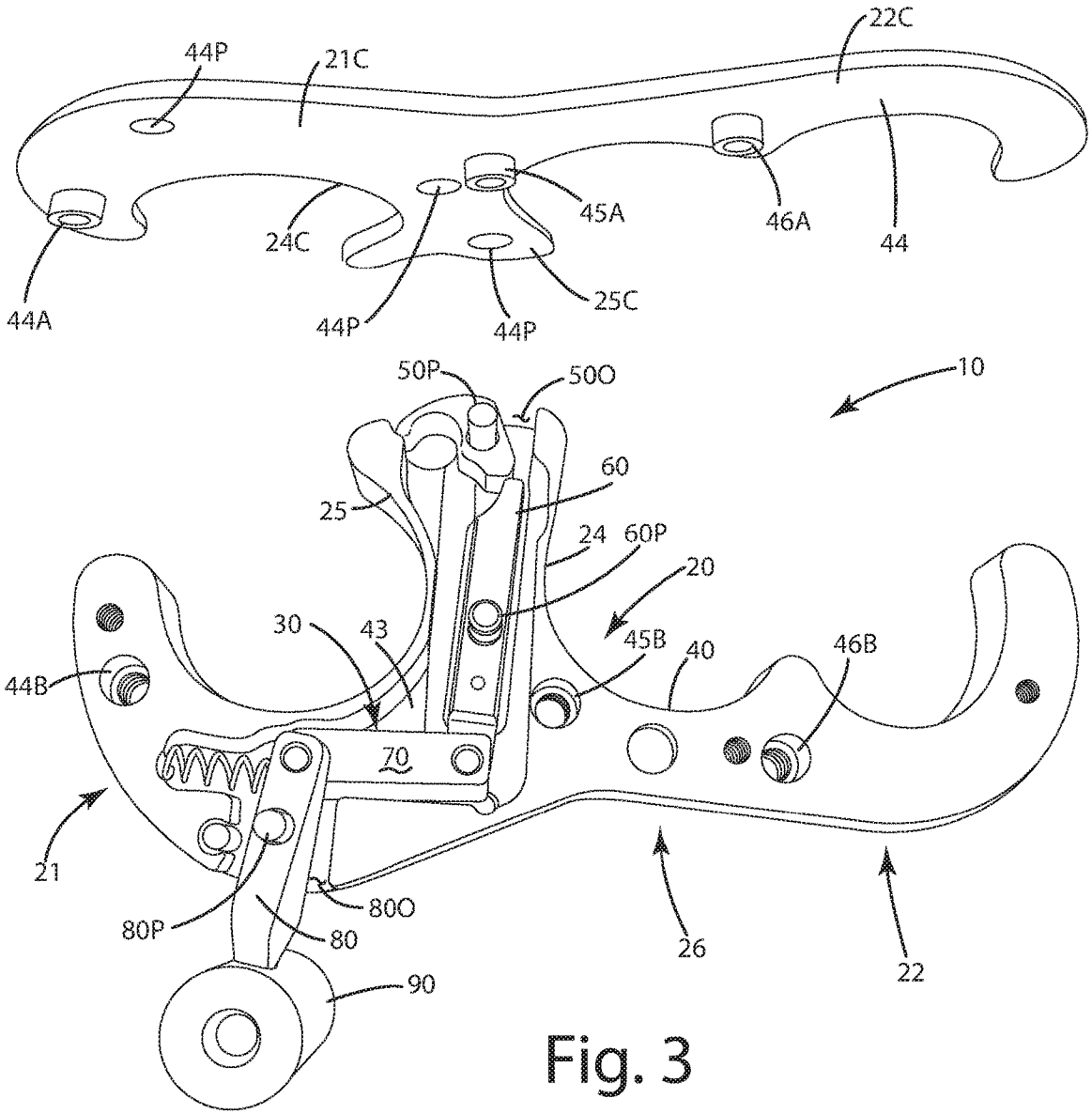
FIG. 3 is a partially exploded view of the release with a cover removed from a housing of the release.
Figure 4:
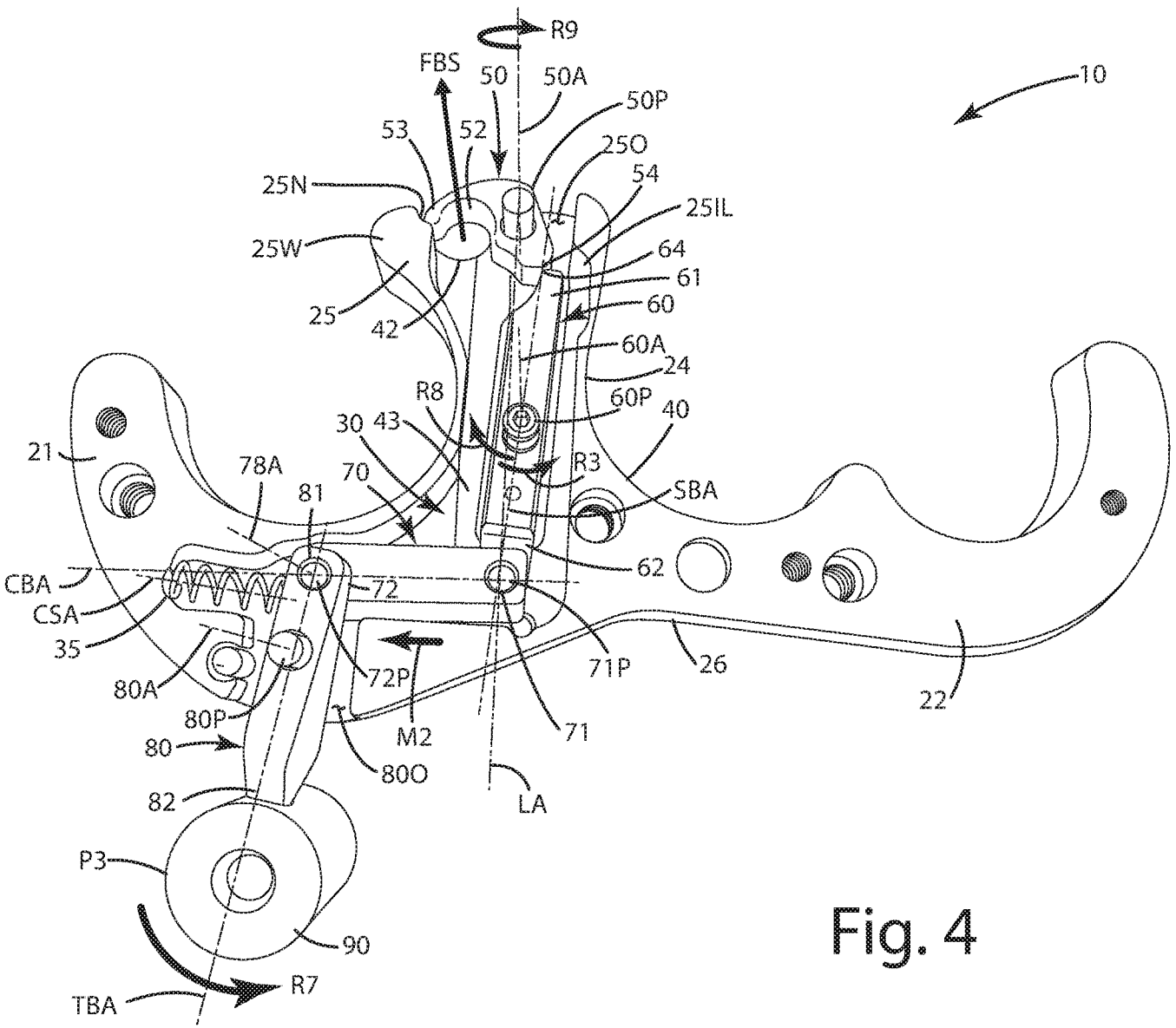
FIG. 4 is a top view of the release with the cover removed showing a multi-bar linkage in a set mode.

Turning now to the individual components of the release 10, reference is made to FIGS. 3 and 4. To begin, the sear 50 as mentioned above is pivotally and rotatably mounted to the housing 40 via the sear pin 50P. The sear 50 can be constructed to define a bowstring notch 52 which directly engages the bowstring of an archery bow. The bowstring notch can include a curvilinear, planar or other smooth surface configured to minimize wear on a bowstring. The bowstring notch can be a U or V shaped opening or recess configured to capture at least a portion of the bowstring.

The sear 50 can include a distal tip 53. Opposite the distal tip 53 is a sear edge 54. The sear 50 can be configured to rotate about the axis 50A and about a sear pin 50P when the release is in the release mode. The distal tip 53 can be configured to engage a portion of the release head 25 when the release and sear 50 are in a set mode as shown in FIG. 4. In particular, the distal tip 53 can seat within a notch 25N defined by the release head 25 in a wing 25W of the release head, distal from the sear pin 50P. The wing 25W can at least partially enclose a secondary bowstring notch 42 of the housing or head that cooperates with the bowstring notch 52 of the sear 52 to circumferentiate or at least partially circumferentiate the bowstring 101 disposed therein. The distal tip 53 can directly engage or at least be adjacent the notch 25N and/or a portion of the release head 25 when the sear and release are generally in the set mode shown in FIG. 4. In that configuration, the sear edge 54 of the sear 50, which again is disposed on an opposite side or portion of the axis 50A from the distal tip 53, can be engaged with the sear bar 60.

In particular, the sear edge can be placed adjacent and/or can engage the bar edge 64. This bar edge is configured to selectively engage the sear edge 54 of the sear 50 when the release 10 is in the set mode shown in FIG. 4. The respective sear edge 54 and bar edge 64 can be precisely formed as beveled edges, optionally polished to a high degree to provide a crisp and clean release when these edges disengage one another. Optionally, both the sear 50 and the trigger bar 60 can be formed from stainless steel or some other fine grade steel, metal or material, having a smooth outer finish that promotes movement and sliding of the sear in the sear bar relative to one another. As also shown in FIG. 4, a portion of the sear 50 can extend at least partially from the sear opening 250 defined by the release head 25. The hook portion forming the bowstring notch 52 of the sear 50 can extend outward from the sear opening 250 and the housing near that opening.

With reference to FIG. 4, the sear bar 60 as shown is an elongated bar extending generally through the arm 24 and into the head 25 of the release. The sear bar also extends away from the sear and into the handle 26, generally within the compartment 43 defined by the housing. The sear bar 60 can include a first end 61 and a second end 62 distal from one another. These ends can be disposed on opposite sides of the sear bar pin 60P and the axis 60A about which the sear bar 60 rotates. The first end 61 can include the bar edge 64. A portion of the housing 40 also can include a first end notch 25K defined in the head 25 of the release. This notch can accommodate the first end 61 when the sear bar 60 is in release mode with the remainder of the release components. Generally, the sear bar 60 is rotatable about the sear bar axis 60A and the sear bar pin 60P that is joined with the arm 24 and/or the handle 26, and that extends in the compartment. The sear bar pin 60P is distal from the sear pin 50P and the sear bar axis 60A is distal from the sear axis 50A when the release is converted from the release mode to the set mode or vice versa. The second end 62 of the sear bar 60 can be connected to the connector bar 70 via a first connector bar pin 71. In general, the first end 61 of the sear bar 60 can be free and unconnected, or not pivotally connected to, another element of the multi-bar linkage 30, while the second end 62 of the sear bar 60 is pivotally connected to the connector bar 70. The free end 61 of the sear bar 60 can selectively engage and disengage the sear 50 depending on whether the release is in the set mode or the release mode.

The connector bar 70 can include a first end 71 that is joined with the sear bar 60 via the first connector bar pin 71P as mentioned above. The connector bar 70 can include a distal opposing second end 72 that includes a second connector bar pin 72P which itself is joined with the trigger bar 80. The second end 72 of the connector bar is distal from the first end 71. The connector bar 70, unlike the sear bar 60, is free-floating within the compartment 43. For example, the connector bar is not connected with any pins that extend into the housing and/or the cover. Optionally, the connector bar is suspended and movable in the compartment by the sear bar and the trigger bar. The connector bar and its respective pins do not contact the housing and/or portions of the compartment or cover in its movement. This connector bar, however, may be contacted by a bias element 35 as described below to affect relative movement of the sear bar.

In contrast, the sear bar 60 is connected via a pin 60P that extends into the housing 40 and also into the cover 44. This allows the sear bar to precisely rotate about that pin 60P. The connector bar 70 is not joined with and does not pivot about any pin or element that is directly joined and fixed relative to the housing. Instead, the connector bar 70 can move within the compartment in both a linear and rotational movement that is not fixed about a particular axis associated with the housing 40.

Figure 5:
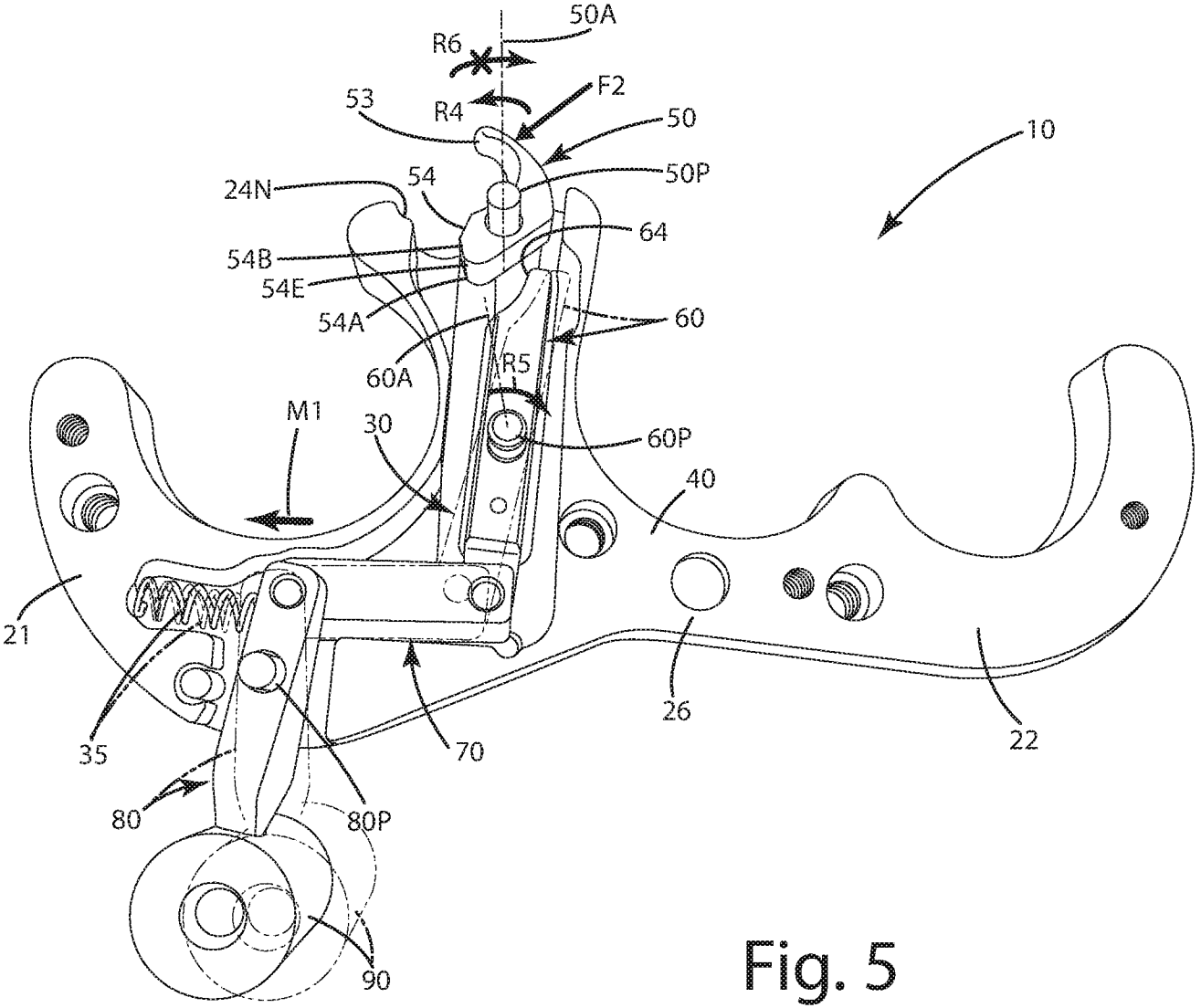
FIG. 5 is a top view of the release with the cover removed showing the multi-bar linkage in the release mode.

As shown in FIGS. 4 and 5, the connector bar is transverse to the sear bar and is also transverse the trigger bar in both the release mode in the set mode. Generally, the three bar linkage 30, including the sear bar 60, the connector bar 70 and the trigger bar 80 is snaked through the compartment 43. The linkage can be in the form of a Z or S shape as it snakes through the compartment, from the sear 50 to the trigger button 90. The connector bar optionally can be transverse to the arm 24 and parallel to the handle 26 of the release.

The connector bar 70 can include a connector bar longitudinal axis CBA. This connector bar longitudinal axis CBA can be transverse to the trigger bar axis TBA of the trigger bar 80. It also can be transverse to the sear bar axis SBA and the release head axis LA of the release head. In some cases, the trigger bar axis TBA and the sear bar axis SBA can be parallel to one another and transverse to the connector bar axis CBA of the connector bar 70. In some cases, the sear bar longitudinal axis CBA can be offset about 70° to about 100°, inclusive, relative to the connector bar longitudinal axis CBA. The trigger bar longitudinal axis TBA optionally can be offset about 70° to about 110°, inclusive, relative to the connector bar longitudinal axis CBA on an opposite side of the connector bar longitudinal axis CBA from the sear bar 60. Of course, the respective trigger bar axis and sear bar axis can be offset at other angles relative to the connector bar longitudinal axis depending on the application and configuration of the handle and release head.

As shown in FIGS. 4 and 5, the release 10 can include a bias element 35 that is disposed in a portion of the compartment 43 that is common to the connector bar 70. This bias element as shown can be in the form of a coil spring having a spring longitudinal axis CSA that is parallel to the connector bar longitudinal axis CBA. The coil spring can be biased against the second end 72 of the connector bar and/or a portion of the trigger bar 80 as described below. The spring can be disposed between the sear bar pin 60P and the trigger bar pin 80P, and can exert a bias against at least one of the trigger bar, the connector bar and the sear bar so the release is maintained or is in the set mode. The bias element 35 can exert a force F against the connector bar so that the sear bar 60 is urged to rotate in direction R3 about the axis 60A. In turn, this engages the bar edge 64 with the sear adjacent the sear edge 54 of the sear 50. In turn, this holds and pushes the sear about the axis 50A so that the distal tip 53 engages or comes adjacent the portion of the release head 25, for example, the notch 25N in the set mode of the release. In turn, this maintains the sear in that set mode so a bowstring in the notch 52 will be captured and held in that notch in the set mode as described below.

Returning to the multi-bar linkage 30, it also can include a trigger bar 80 as mentioned above. The trigger bar 80 can be joined with the housing 40 via the trigger bar pin 80P. This pin 80P can extend into a recess defined by the housing in the bottom of the compartment 43 and also into a recess 44P defined by the cover to stabilize the pin, so that the trigger bar 80 can rotate cleanly about that pin. The trigger bar 80 can include a first end 81 which is joined with the second end 72 of the connector bar 70 via the second pin 72P. The trigger bar 80 can include a second end 82 that extends outward and projects away from the release. That second and 82 can be joined with a trigger button 90 which optionally can be in the form of a thumb peg as shown. The thumb peg can be screwed, fastened or otherwise joined with the second end of the trigger bar 82. The trigger bar 80 can extend from the trigger bar opening 800 defined by release and the housing in general. Optionally, this can be one of two openings that are defined by the release and the housing from which components of the multi-bar linkage and the sear extend. These can be the only two openings of the housing and generally the compartment which open from the release and the housing. The trigger bar opening 800 can be disposed and generally defined by a portion of the primary portion 21 of the handle 26. Optionally, the secondary portion 22 defines no other openings from which the multi-bar linkage or other portion of the release that configures the release in the set mode or the release mode, projects. Of course, there can be openings or recesses associated with the pins that align the cover and the housing or handle, but these are not considered functional openings of the housing, like the sear opening 250 and the trigger bar opening 800.

With reference to FIGS. 1-4, the handle 26 can include a secondary handle portion 22 that can extend outward and away from the arm 24 and the primary handle portion 21, generally on the opposite side of the longitudinal axis LA of the arm 24 and body 20 from the primary handle portion 21. The primary handle portion 21 can extend laterally away from the arm in direction D1 from the longitudinal axis LA of the arm. The secondary portion 22 can extend laterally away from the arm 24 in a second direction D2 opposite the first direction D1.

Operation of the release 10 in the respective set mode and release modes will now be described in further detail with reference to FIGS. 1-5. To begin, with reference to FIGS. 2 and 5, the release 10 is in a release mode, or alternatively, shown before it is reset to a set mode. Referring to FIG. 5, the archer, when converting the release shown there to a set mode, can rotate the sear 50 in direction R4 about the axis 50A until the distal tip 53 enters the notch 24N. Typically this is done when the bowstring 101 is in the bowstring notch 52 and the corresponding housing notch 42 as shown in FIG. 1. The sear 50 can rotate about the pin 50P until the first face 54A of the sear edge 54 engages the bar edge 64. At this point, the user continues to exert a force F2 in direction R4 to continue rotating about the axis 50A. As this rotation continues, the edge 54B clears the bar edge 54E. Upon the application of the force F2, that force F2 further rotates the sear bar 60 about the axis 60A in direction R5. As a result, the connector bar 70 is moved in direction M1 to compress the bias element 35. When the bias element 35 is adequately compressed, the bar edge 64 can clear the sear edge 54E and can engage the resting portion 54B of the bar edge 54. In this configuration, the sear cannot be rotated in direction R6 until the release 10 is converted to the release mode. In this configuration as well, a bowstring 101 held within the notch 52 and notch 42 is effectively captured there, with the release attached to the bowstring. At the end of the set mode, the release appears as shown in FIGS. 1 and 4. There, the sear again 50 cannot rotate in direction R6. The distal tip 53 is engaged with the notch 24 and the release head. The bar edge 64 is engaged against the sear edge 64, with the bias element 35 exerting a force F to hold the release in the configuration shown in FIG. 4. It is noted that to engage the sear 50 and the multi-bar linkage 30, and generally the release 10 into the set mode, it is the multi-bar linkage and bias element alone that accomplishes this conversion to this mode. No other input from other components is utilized, that is, there is no other linkage or set of pawls and sears used to set the release into this set mode shown in FIG. 4.

The release 10 also is operable in a release mode when converted from the set mode to the release mode shown in FIGS. 1 and 4. To attain a release mode, the user engages the trigger button 90 with a force F3 to rotate the trigger bar 80 in direction R7 about the axis 80A associated with the trigger pin 80P. As a result, the first end 81 of the trigger bar 80 moves against the bias element 35 to compress the bias element, countering the force F typically exerted by that bias element 35. Upon such compression, the connector bar 70 moves in direction M2. Due to the connection of the connector bar to the second end 62 of the sear bar 60, the sear bar rotates in direction R8 about the axis 60A. When this occurs, the first end 61 of the sear bar 60 moves away from the sear pin 50P. Further, the bar edge 64 disengages the sear edge 54. Upon such disengagement of the sear edge with the bar edge, the sear 50 is free to rotate about the pin 50P and the axis 50A. When the bowstring 101 exerts a bowstring force FBS against the notch and the sear, the sear 50 thus rotates in direction R9 about the axis 50A. As a result, sear swings open and releases the bowstring from the bowstring notch 52. As a result, the bow to which the bowstring is attached is shot and an associated arrow can be propelled via the bowstring and bow.

After the release is released to the release mode, thereby releasing the bowstring, a user can reset the release to the set mode as described above. The above process can be utilized multiple times to set the release to a set mode and use the release to release the bowstring from the release. With the above construction, the three-bar or multi-bar linkage effectively operates as two systems, both to set the release to a set mode, and to release the release to a release mode. This minimizes the number of parts and assemblies to perform both of these distinct functions. Further, with this construction, few components are constructed to exacting standards and finished such that they minimize friction. In particular, the sear and the sear bar can be constructed to such tolerances and with such finishes because these are the only two components that are responsible for release of the bowstring. The other bars, for example the connector bar in the trigger bar can be of a lower grade, less precision formed material, which can reduce construction cost. Further, because the release utilizes a system where the multi-bar linkage only rotates on two fixed axes, for example, the axes 80A and 60A of the respective pins, friction throughout the system can be reduced. In addition, the number of parts used in the releases also is significantly minimized. Further, assembly of such a minimal number of parts takes less time.

The components of the releases herein, for example, the handle, the release head and their parts can be constructed from a variety of materials, for example, metal, such as steel, stainless steel and aluminum, as well as other synthetic materials such as polymers, and any combination of the foregoing. Further, the releases and components can be treated with special processes, for example, anodizing, dipping or filming to provide the release and its components with a desired finish and appearance. In general, components of the releases, such as the release head, first adjuster and adjuster linking element can be molded, machined and/or extruded to obtain their desired configuration. These components can also be treated with special processes as described above to provide a desired finish.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An archery release comprising:

a release head including a sear defining a bowstring notch configured to engage a bowstring, the sear rotatably mounted to the release head in a compartment defined at least partially by the release head, the sear including a sear edge;

an arm extending rearward from the release head and configured to fit between adjacent fingers of a user, the compartment defined at least partially by the arm;

a handle joined with the arm, the handle extending laterally away from the arm in a first direction on a first side, and laterally away from the arm in a second direction opposite the first direction, on a second side, the compartment defined at least partially by the handle;

a sear bar extending within the compartment including a bar edge configured to selectively engage the sear edge, the sear bar rotatable about a sear bar axis;

a connector bar pivotally joined with the sear bar distal from the bar edge; and a trigger bar pivotally joined with the connector bar distal from the sear bar, the trigger bar rotatable about a trigger bar axis, the trigger bar extending from the handle on the first side and joined with a trigger button that is transverse to the trigger bar and manually accessible by a thumb of a user engaging the handle, wherein the release is operable in a set mode in which the bar edge engages the sear edge so that the sear is non-rotatable about the sear axis and configured so the bowstring is retained in the bowstring notch, wherein the release is operable in a release mode in which the bar edge disengages the sear edge to enable the sear to rotate about the sear axis, so the bowstring is released from the bowstring notch.

2. The archery release of claim 1 comprising:

a bias element biased against the connector bar so that the sear bar is urged to the set mode so the sear is non-rotatable about the sear axis.

3. The archery release of claim 2, wherein the sear bar extends through the arm and is rotatable about a sear bar pin joined with the arm, the sear bar pin extending into the compartment, wherein the sear bar pin is distal from the sear axis.

4. The archery release of claim 3, wherein the connector bar extends through the handle, wherein the connector bar is free floating within the compartment.

5. The archery release of claim 1, wherein the connector bar includes a first end joined with the sear bar via a first connector bar pin, wherein the connector bar includes a second end joined with the trigger bar via a second connector bar pin, the second end distal from the first end, wherein the connector bar is transverse to the sear bar, wherein the connector bar is transverse to the trigger bar.

6. The archery release of claim 5, wherein the connector bar is offset at a first angle between 75° and 105°, inclusive, relative to the sear bar, wherein the connector bar is offset at a second angle between 75° and 105°, inclusive, relative to the trigger bar.

7. The archery release of claim 1, wherein the compartment extends adjacent an intersection of the connector bar and the trigger bar, wherein a spring is disposed in the compartment adjacent the intersection, wherein the spring urges the sear bar to rotate about the sear bar axis and urges the trigger bar to rotate about the trigger bar axis so that the sear bar is urged to the set mode.

8. The archery release of claim 7, wherein the spring is aligned with a longitudinal axis of the connector bar.

9. The archery release of claim 8, wherein the release head, arm and handle form a housing defining the compartment, wherein the housing defines a sear opening from which a hook of the sear extends, wherein the housing defines a trigger opening from which the trigger bar extends, wherein the housing is void of any other openings other than the sear opening and the trigger opening.

10. The archery release of claim 1, wherein the sear includes a distal tip, wherein the sear bar engages the sear which engages the distal tip against the release head to hold the sear in the set mode.

11. An archery release comprising:

a housing including a handle having a forward extending arm joined with a release head, the housing defining a compartment;

a sear having a bowstring hook, the sear pivotally mounted to the housing about a sear axis, the sear having a sear edge;

a sear bar extending within the compartment and including a bar edge configured to selectively engage the sear edge, the sear bar rotatable about a sear bar axis;

a connector bar pivotally joined with the sear bar distal from the bar edge; and a trigger bar pivotally joined with the connector bar distal from the sear bar, the trigger bar rotatable about a trigger bar axis, the trigger bar extending from the housing and joined with a trigger button;

wherein the release is operable in a set mode in which the bar edge engages the sear edge to set the sear so that the sear is nonrotatable about the sear axis and so the bowstring is retained in the bowstring notch, wherein the release is operable in a release mode in which the bar edge disengages the sear edge to enable the sear to rotate about the sear axis, so the bowstring is released from the bowstring notch.

12. The archery release of claim 11, wherein the connector bar includes a first end pivotally connected to the sear bar with a first pin, wherein the connector bar includes a second end pivotally connected to the trigger bar with a second pin, wherein the connector bar is suspended in the compartment by the sear bar and the trigger bar.

13. The archery release of claim 11 comprising:

a bias element that is biased against at least one of the trigger bar and the connector bar when the release is in the set mode, wherein the bias element is disposed in the housing.

14. The archery release of claim 13, wherein the bias element is a coil spring having a longitudinal axis that is parallel to a longitudinal axis of the connector bar.

15. The archery release of claim 11, wherein the sear bar is joined with the housing via a sear bar pin, wherein the trigger bar is joined with the housing via a trigger bar pin, wherein a spring is disposed between the trigger bar pin and the sear bar pin to exert a bias force against at least one of the trigger bar, the connector bar and the sear bar so the release is in the set mode.

16. The archery release of claim 15, wherein the bowstring hook includes a distal tip that engages the housing distal from the sear axis when the release is in the set mode.

17. The archery release of claim 11, wherein the connector bar includes a connector bar longitudinal axis, wherein the sear bar includes a sear bar longitudinal axis, wherein the trigger bar includes a trigger bar longitudinal axis, wherein the sear bar longitudinal axis is offset about 70° to about 110° inclusive relative to the connector bar longitudinal axis, wherein the trigger bar longitudinal axis is offset about 70° to about 110° inclusive relative to the connector bar longitudinal axis on an opposite side of the connector bar longitudinal axis from the sear bar.

18. The archery release of claim 17, wherein the sear bar, the connector bar and the trigger bar form a three bar linkage, wherein the three bar linkage is urged to the set mode via a spring, wherein the spring is in an extended state in the set mode, wherein the three bar linkage is freed from the set mode and transitions to the release mode when the trigger bar is rotated about a trigger bar axis so as to compress the spring, thereby allowing the sear bar to rotate sufficiently to disengage the bar edge from the sear edge to transition to the release mode.

19. An archery release comprising:

a housing including a handle including an arm that extends to a release head having a sear defining a bowstring notch, the housing defining a compartment;

a three bar linkage snaking through the compartment and configured to engage the sear at a first end and to project rearward from the handle at a second end, at which a trigger button is disposed and oriented to be selectively engaged by a thumb of a user;

a bias element engaging the three bar linkage, wherein the release is operable in a set mode in which the sear is nonrotatable about the sear axis and so the bowstring is retained in the bowstring notch, wherein the release is operable in a release mode in which the sear is rotatable about the sear axis, so the bowstring is released from the bowstring notch, wherein the three bar linkage includes an elongated sear bar, an elongated connector bar and an elongated trigger bar extending though the compartment, wherein the elongated sear bar is pivotally joined with the elongated connector bar via a first pin, wherein the elongated connector bar is pivotally joined with the elongated trigger bar via a second pin.

20. The archery release of claim 19, wherein the elongated connector bar includes a connector bar longitudinal axis, wherein the elongated sear bar includes a sear bar longitudinal axis, wherein the elongated trigger bar includes a trigger bar longitudinal axis, wherein the sear bar longitudinal axis is offset about 70° to about 110° inclusive relative to the connector bar longitudinal axis, wherein the trigger bar longitudinal axis is offset about 70° to about 110° inclusive relative to the connector bar longitudinal axis on an opposite side of the connector bar longitudinal axis from the elongated sear bar.

* * * * *